United States Patent [19]

Scrivnor

[11] Patent Number: 4,568,022

[45] Date of Patent: Feb. 4, 1986

[54] SPRAY NOZZLE

[75] Inventor: Warren A. Scrivnor, Baltimore, Md.

[73] Assignee: Baltimore Aircoil Company, Inc., Jessup, Md.

[21] Appl. No.: 137,327

[22] Filed: Apr. 4, 1980

[51] Int. Cl.[4] ..... B05B 1/06

[52] U.S. Cl. ..... 239/207; 62/304; 239/209; 239/524; 239/553.5; 239/590.5

[58] Field of Search ..... 239/207, 209, 518, 524, 239/550, 566, 567, 590, 553.5, 590.5; 261/98, 111; 62/304, 310

[56] References Cited

U.S. PATENT DOCUMENTS

| | | | |
|---|---|---|---|
| 477,824 | 6/1892 | Robinson | 239/590.5 |
| 1,286,333 | 12/1918 | Johnson | 239/524 |
| 3,101,176 | 8/1963 | Goss | 239/524 |
| 3,517,886 | 6/1970 | Dyck | 239/518 |
| 3,617,036 | 11/1971 | Brown | 261/111 |
| 3,737,106 | 6/1973 | Arnold et al. | 239/518 |
| 3,756,515 | 9/1973 | Arnold | 239/524 |
| 3,826,427 | 7/1974 | Rutherford | 239/524 |
| 4,058,262 | 11/1977 | Burnham | 239/550 |

FOREIGN PATENT DOCUMENTS

| | | | |
|---|---|---|---|
| 1106820 | 12/1955 | France | 239/524 |
| 496231 | 11/1938 | United Kingdom | 239/553.5 |

*Primary Examiner*—Andres Kashnikow
*Assistant Examiner*—Michael J. Forman
*Attorney, Agent, or Firm*—Charles E. Bouton; Edward J. Brosius

[57] ABSTRACT

A spray nozzle, which is attached to a conduit or header carrying a fluid under pressure, the purpose of which is to generate a circular umbrella type liquid spray. Spray nozzle includes a cylindrical member and a baffle therein. The spray nozzle receives liquid from the header and conducts it to its concavely curved dispersing member from where it is discharged in a circular spray pattern to a bank of tubes or cooling tower fill below.

4 Claims, 4 Drawing Figures

SPRAY NOZZLE

BACKGROUND OF THE INVENTION

There has been a need in the art for a spray nozzle, to be used in typical evaporative heat exchangers, which provides a generally circular and umbrella-like spray pattern over a wide range of fluid pressures. Use of such nozzles makes it possible to maintain the heat exchanger fully wetted so as to maximize heat transfer and/or minimize scale formation.

Further, in typical evaporate heat exchangers it has been customary to provide several liquid carrying headers located in superposed relation spanning either a bank of tubes carrying a fluid to be condensed and/or cooled or spanning cooling tower fill. A plurality of smaller tubes or branches extend laterally from the headers, with each branch containing one or more nozzles which emit spray patterns which impinge on the fluid carrying tubes or fill. In this prior application, fine sprays have been used because of the relatively large ratio of drop surface area to drop volume which results in optimum evaporative cooling efficiency.

Accordingly, it had been necessary to provide multiple arrays of such small fine spray nozzles. The number of nozzles in a typical prior art installation may be on the order of one or more nozzles per square foot of plan area of the heat exchanger. These are arranged in a generally uniform spacing to obtain an overall rectangular spray pattern within the usually rectangular plan area of such heat exchange units. A great deal of mist is generated by such sprays and much of this impinges on the walls of the unit or is carried upwardly by rising convention air currents requiring the use of complex drift eliminators to avoid loss of cooling water.

In another typical prior art installation as shown in U.S. Pat. No. 4,058,262 there is shown use of spray nozzles wherein each nozzle forms with another a cooperative pair to form a generally rectangular spray pattern in a liquid heat exchanger or evaporation system. The nozzles shown in this patent must work one in conjunction with another and only emanate individually a generally semicircular spray pattern. The fact that the nozzles in this patent do not emit a circular spray pattern leads one to use many more nozzles than are needed in the subject invention.

Further, the sprays from the nozzles shown in U.S. Pat. No. 4,058,262 do not interact in a manner such that the spray fluid is uniformly distributed over the surface area beneath said nozzles.

Also, there is provided in U.S. Pat. No. 3,617,056 a type of nozzle to be used mainly in gravity feed operations, said nozzle having a specifically constructed bottom plate to distribute the fluid in a desired pattern.

Applicant has found an improved spray nozzle which provides sufficient fluid flow over a wide range of fluid pressures and has provided a nozzle which can be economically manufactured. Further, applicant has found an improved spray nozzle which provides an umbrella-type spray pattern that interacts with the spray patterns from adjacent nozzles, in both length and width directions, to uniformly distribute the spray fluid over the surface area beneath the nozzles, while at the same time requiring a minimum number of nozzles.

It is an object of this invention to provide an improved spray nozzle to be used with headers wherein liquid to be distributed is under pressure which emits a circular 360° uniform umbrella-like spray pattern over a wide range of said liquid pressures.

It is a further object of this invention to provide a nozzle of a relatively simple design that is economically feasible to manufacture and which not only distributes the liquid in a circular 360° spray pattern but distributes said liquid uniformly over the 360° pattern for a wide range of pressure of said liquid in said header.

A still further object of this invention is to provide an improved spray nozzle which results in the use of less nozzles than previous spray systems.

The above and other objects and advantages will become apparent from the following description and from the accompanying drawings and will be recognized by those skilled in the art.

Figure 1:
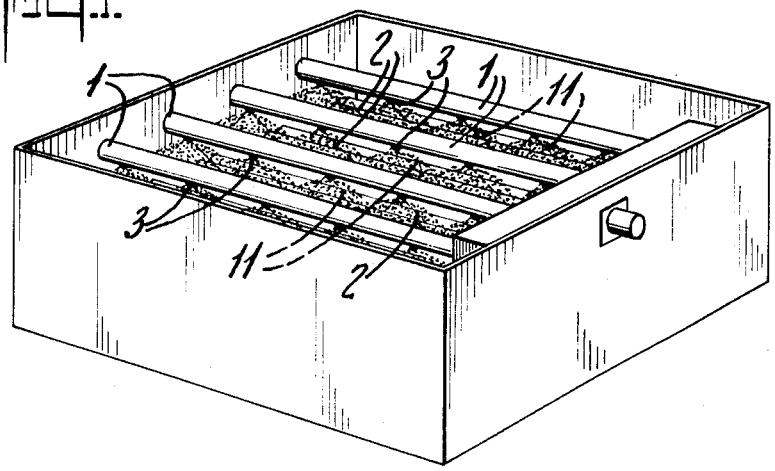
FIG. 1 represents a top view of the headers and typical spray nozzles spaced along these headers which formation is located above a tubular medium or tower fill in the evaporative system.
Figure 4:
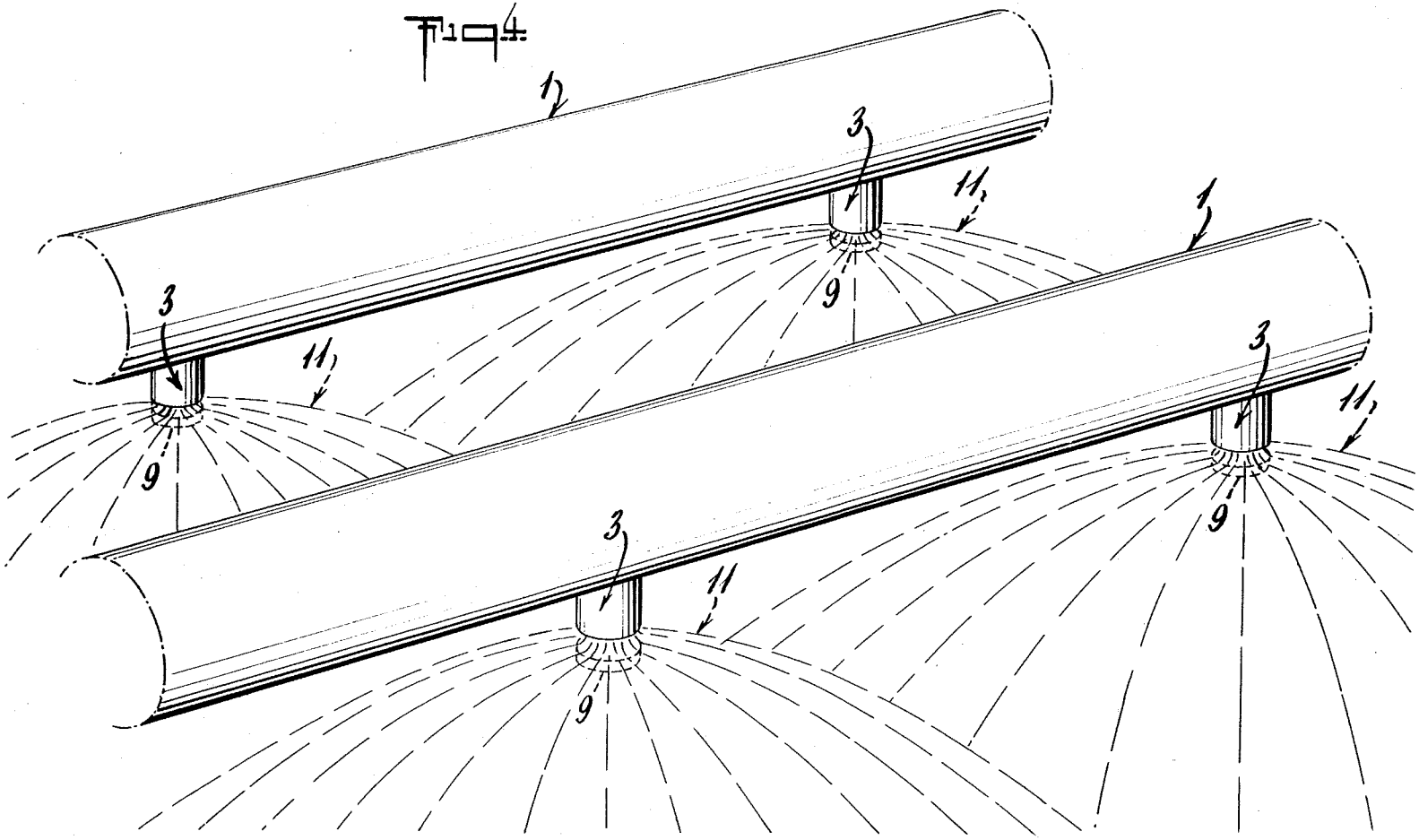
FIG. 4 is an isometric view of a typical header and nozzle arrangement showing the type of sprays emanating from the nozzles.

In FIGS. 1 and 4 there is shown a portion of a spray branch or header 1 for carrying fluid (particularly water) under pressure. The spray branch spans cooling coils 2 in the form of banks of tubes carrying a heated fluid or it spans cooling tower fill. In the former situation, that is where the liquid is sprayed over tubular coils, the spray from the nozzles, perhaps combined with the forced circulation of air removes heat from the fluid in the tubes. The said fluid mentioned previously could be a liquid such as water or could be a refrigerant such as ammonia or a fluorocarbon compound. In the latter situation, that is where the liquid is sprayed over cooling tower fill, the sprayed liquid is cooled as it descends over the fill. Cooling of the sprayed liquid in this situation can be with or without the assist of forced air circulation.

As shown nozzles 3 of identical construction extend radially downward from the header and may be disposed about 4–12" above the top layer of the tubular coils or fill surface 2.

The nozzles may be attached by typical screw thread engagement with the spray branch or header or preferably the nozzle is merely fitted into the bottom of the header through a ciruclar hole in said header and a seal obtained by using a grommet or rubber washer. This latter method of attachment provides for easy removal of said nozzle from the header should the need periodically arise.

Each nozzle includes a thin walled cylindrical member 4 having an axial bore 5, which communicates with the inner diameter of the pipe, conduit or header 1 so that the water or other fluid medium under pressure within the header will flow into the bore 5 of each nozzle. A water pressure in the range of 0.5 to 20 psi is suitable for the practice of this invention. At its lower end 6 the cylindrical member by means of a support member 7 terminates in a generally concave surface 8, on a circular dispersing member 9, the concave surface of which faces toward the header. As a result of this construction, water under pressure flows smoothly and evenly from the bore 5 to the concave spherical surface of the dispersing member and out through the orifice 10 as a thick or deep 360° circular umbrella-type spray 11.

Figure 2:
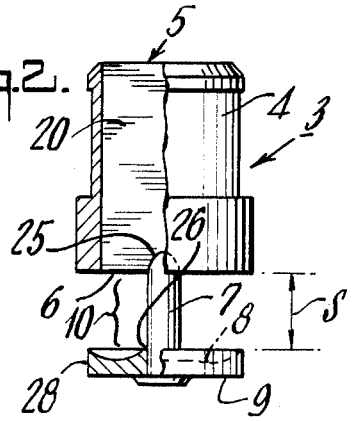
FIG. 2 is a side view of a typical nozzle of this invention.
Figure 3:
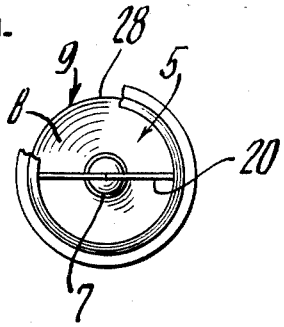
FIG. 3 is a top view of a typical nozzle of this invention.

Each nozzle as shown in FIGS. 2 and 3 is provided with a baffle plate 20 which runs diametrically in the bore or parallel with the bore of the cylindrical member of the nozzle. This baffle plate is located within the cylindrical member and runs along the axis of the bore thereby dividing the bore into two semi-circle portions. The baffle is located preferably along the diameter line of the bore and extends up to the upper end of the cylindrical member so that it is flush with the upper end of said cylindrical member. For optimum performance, the baffle must be located in the bore so that it is perpendicular to a liquid flow in the spray branch or header 1. If the baffle is not so oriented, uniformity of distribution of the spray liquid will be reduced.

To insure that the baffle is perpendicular to the flow of liquid in the headers, a small distinguishing mark can be made on the outside surface of the cylindrical member showing the exact position of the baffle. Anyone then inserting or attaching the nozzle to the header will be immediately aware of the orientation of the baffle plate and can thus insert the nozzle with the proper orientation.

When the baffle is perpendicular to liquid flow in the spray branch, the two parts of the bore receive equal flow of liquid and the spray pattern emanating from the nozzle will be uniform. If this baffle is not provided within the bore of the cylindrical member in the nozzle, then the flow coming out of the nozzle will be disproportionately high in the direction of flow of liquid in the spray branch. Preferably the circular dispersing member of the nozzle 9 which is in the form of a cone or concave surface area as shown by 8 in FIG. 2 is spaced a finite distance from the cylindrical end of the bore and baffle to provide a nozzle orifice 10. It is preferably held at this distance by a supporting piece generally in the shape of a column 7 which has one end terminating at the baffle plate 25 and the other end in the center of the circular dispersing member 26. The circular dispersing member extends circumferentially from the center in a generally parallel spaced relationship from the lower end of the cylindrical member as shown by 6 in FIG. 2. The circular dispersing member terminates in a circular edge or radius at the outer peripheral ends of the circular dispersing member.

The orifice of the nozzle 10 or the spacing of the outer peripheral ends from the lower end of the cylindrical member is generally a distance of about $\frac{1}{8}''$–$\frac{3}{4}''$ (3 mm to 19 mm) and preferably from $\frac{1}{4}''$–$\frac{1}{2}''$ ($6\frac{1}{2}$ mm to 13 mm). This dimension is shown as "S" in FIG. 2. This distance creates an orifice which will provide a generally thick or deep umbrella-type spray blanket substantially uniformly distributed in a 360° circle about the dispersing member.

The baffle plate 20 should preferably be located so that its top edge is flush with the top of the cylindrical member 4, i.e., flush with the top opening of the bore. The baffle plate 20 should be made of a sturdy material such as stainless steel or a strong plastic, as it must be rigid, but it should not take up any more of the cross-sectional opening area of the bore than necessary.

Similarly, the cylindrical member, the support member and the dispersing member can be made of any compatible material, but it is preferably made of plastic or synthetic plastic material, for ease or construction and economy. Also, the entire nozzle can be made in sections with the dispersing member 9 and baffle 20 being physically attached (with adhesive or thermal welding) to each end of the support member 7, or it can be molded in one piece.

In a typical application of the nozzles for use in distributing a fluid over tubular members 2 as shown in FIGS. 1 and 4, the nozzles should be spaced about 12" (305 mm) apart along each spray branch or header and each spray branch should be spaced about 29" (737 mm) from the adjacent spray branches. Further, the nozzles 3 should be elevated about 5 inches (127 mm) above the top surface of the coils 2. At these conditions and at an application of about $12\frac{1}{2}$ gallons of liquid per minute flowing through each nozzle, the liquid will be thrown out in an umbrella pattern in approximately a 26" (660 mm) diameter circle from each nozzle at the point just above the tubular coils. For the stated conditions, the distribution of the fluid over the tubular coils in a typical evaporative exchange situation where these nozzles are used is quite uniform.

In the other application wherein the nozzles are used in dispersing liquid over cooling tower fill, the nozzles should be spaced about 8" (203 mm) apart along each spray branch or header and each spray branch should be spaced about 37" (940 mm) from the adjacent spray branches. The nozzles in this situation should be elevated about 10" (254 mm) above the top of the surface of the fill 2. The fluid is distributed in this situation at the rate of approximately 3 gal/min./ton of cooling capacity. Under these conditions the fluid or liquid to be cooled will be distributed in an umbrella-like spray pattern in approximately a 40" (1016 mm) diameter circle from each nozzle at a point just above the fill. Here again distribution of the fluid is quite uniform since the spray patterns interact to create a uniformly distributed fluid pattern.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed is:

1. A spray nozzle device for application in evaporative cooling or condensing of fluids in tubular media having a generally planar upper surface comprising:

(a) a header carrying liquid flow under pressure disposed above said surface;

(b) a series of nozzles spaced along said header, each nozzle having a thin walled cylindrical member having a bore therein; and said cylindrical member having upper and lower edges;

(c) a baffle having an upper and lower portion and two sides, said baffle being located diametrically within the bore of said cylindrical member in a generally parallel orientation with said bore with both sides of the baffle contacting the cylindrical member to divide the cylindrical member into two generally semicircular portions, said upper portion of said baffle being flush with the upper edge of said cylindrical member, and also being generally perpendicular to the liquid flow in said header, said baffle distributing the flow of liquid equally and uniformily through the cylindrical member;

(d) a generally circular dispersing member having a concave surface facing the lower edge of said cylindrical member and facing said liquid flow to distribute liquid in an umbrella spray pattern; and (e) a support member attached to said baffle and dispersing member to support said dispersing member and to hold it a finite distance away from said cylindrical member.

2. A spray nozzle apparatus of claim 1 wherein the series of nozzles are spaced along said header at approximately 12" intervals.

3. A spray nozzle device for application in cooling towers, for the cooling of liquid sprayed over fill material in said tower wherein the upper surface of said fill material defines a gernally planar surface comprising:

(a) a header carrying the liquid flow under pressure disposed above said fill material;

(b) a series of nozzles spaced along said header, each nozzle having a thin walled cylindrical member having a bore therein; and said cylindrical member having upper and lower edges;

(c) a baffle having an upper and lower portion and two sides, said baffle being located diametrically within said bore of said cylindrical member in a generally parallel orientation with said bore with both sides of the baffle contacting the cylindrical member to divide the cylindrical member into two generally semicircular portions, said upper portion of said baffle being flush with the upper edge of said cylindrical member, and also being generally perpendicular to the liquid flow in said header, said baffled distributing the flow of liquid equally and uniformily through the cylindrical member;

(d) a generally circular dispersing member having a concave surface facing the lower edge of said cylindrical member and facing said liquid flow to distribute liquid in an umbrella spray pattern; and (e) a support member attached to said baffle and dispersing member to support said dispersing member and to hold it a finite distance away from said cylindrical member.

4. A spray nozzle apparatus of claim 3 wherein the series of nozzles are spaced along said header at approximately 8" intervals.

* * * * *